United States Patent [19]

Savolainen

[11] Patent Number: 4,862,648

[45] Date of Patent: Sep. 5, 1989

[54] METHOD AND DEVICE FOR RENEWAL OF AN INNER FACE OF A ROLL MANTLE OF A SUCTION ROLL

[75] Inventor: Eero Savolainen, Jyväskylä , Finland

[73] Assignee: Valmet Paper Machinery Inc., Finland

[21] Appl. No.: 214,503

[22] Filed: Jul. 1, 1988

[30] Foreign Application Priority Data

Jul. 3, 1987 [FI] Finland ..... 872940

[51] Int. Cl.[4] ..... B24B 5/40; B24B 5/37; B24B 33/02

[52] U.S. Cl. ..... 51/290; 51/245

[58] Field of Search ..... 51/245, 289 R, 290

[56] References Cited

U.S. PATENT DOCUMENTS

| | | | |
|---|---|---|---|
| 2,771,718 | 11/1956 | Gustafson | 51/55 |
| 3,605,346 | 9/1971 | Sprishevsky et al. | 51/290 |
| 4,132,533 | 1/1979 | Löhmer et al. | 51/295 |

*Primary Examiner*—Frederick R. Schmidt
*Assistant Examiner*—Jack Lavinder
*Attorney, Agent, or Firm*—Steinberg & Raskin

[57] ABSTRACT

A method for renewal of an inner face of a roll mantle of a suction roll. A suction box of the suction roll is provided with at least one grinding rib, or with a supply of grinding material, so that the inner face of the roll mantle can be renewed by grinding while rotating the roll mantle. A grinding rib and grinding material may both be simultaneously supplied. Additionally, a device for carrying out such renewal of the inner face of a roll mantle in a suction roll, is also provided.

20 Claims, 2 Drawing Sheets

METHOD AND DEVICE FOR RENEWAL OF AN INNER FACE OF A ROLL MANTLE OF A SUCTION ROLL

BACKGROUND OF THE INVENTION

The present invention is directed to a method for renewal of an inner face of a roll mantle of a suction roll in a paper machine, as well as to equipment used in such a method.

From time to time, inner faces of mantles of suction rolls require surface-processing, since the seals placed at the contact points between the suction box of the suction roll and the roll mantle abrade the inner face of the mantle during operation. In a paper mill, such reconditioning and regrinding of the mantle has previously required detaching of the mantle portion of the suction roll from the suction box and transportation of the suction roll to be reconditioned out of the paper mill for separate machining. The transfer of heavy rolls for grinding of the inner faces has therefore involved high transfer cost, while the machining of the inner face of the roll has also been a time-consuming and costly operation.

SUMMARY OF THE INVENTION

Accordingly, it is an object of the present invention to improve the reconditioning of the inner face of a mantle of a suction roll in a paper machine.

It is also an object of the present invention to provide an improved method for renewal of the inner face of a suction roll in a paper machine.

It is an additional object of the present invention to provide for renewal of an inner face of a mantle of a suction roll in a paper machine, right at the paper mill itself without need for detaching and transferring the suction roll It is a further object of the present invention to facilitate and simplify the reconditioning and renewal of the inner face of a suction roll mantle, without complicated arrangements having to be made.

It is another object of the present invention to provide new and improved equipment for reconditioning and renewing the inner face of a suction roll mantle.

These and other objects are attained by the present invention which is directed to a method for renewal of an inner face of a roll mantle of a suction roll, comprising the step of renewing the inner face of the roll mantle by grinding while rotating the mantle, by at least one of providing a suction box of the suction roll with at least one grinding rib, and providing the suction box with means for supplying grinding material into the roll. The present invention is also directed to a device for renewal of an inner face of a roll mantle of a suction roll, which comprises at least one grinding rib positionable within a suction box of the suction roll, for grinding the inner face of the roll mantle as it rotates.

According to the present invention, it has now been found that the inner face of the suction roll can be ground by making use of existing arrangements of equipment already present at the paper mill, and existing arrangements of equipment present at the suction roll.

The method in accordance with the present invention is principally characterized by the suction box of the suction roll being provided with at least one grinding rib and/or with means for the supply of grinding material, by means of which the inner face of the roll mantle is renewed by grinding while rotating the roll mantle.

The equipment in accordance with the invention for the renewal of the inner face of a suction roll is principally characterized by the equipment comprising at least one grinding rib grinding the inner face of the mantle of the suction roll, and arranged to be fitted in the suction box of the suction roll of the paper machine.

According to the present invention, it has now been found that the sealed sockets for axial seals of the suction box in a suction roll, can be used as fastening means for separate grinding ribs. Furthermore, according to the present invention, it has now been found that the equipment for positioning of the end seals can be utilized for accomplishing a back-and-forth movement of the grinding ribs. An embodiment of the present invention is also possible in which grinding material is passed through pressure medium ducts onto the face to be ground. Therein, an embodiment of the present invention is possible in which the grinding material is passed directed onto the axial seals, such seals being used for the grinding together with the grinding material.

BRIEF DESCRIPTION OF THE DRAWINGS

The present invention will be further described below with reference to certain preferred embodiments illustrated in the accompanying drawings, and to which, however, the present invention is not intended to be exclusively confined. In the drawings.

DESCRIPTION OF THE PREFERRED EMBODIMENTS

Figure 1:
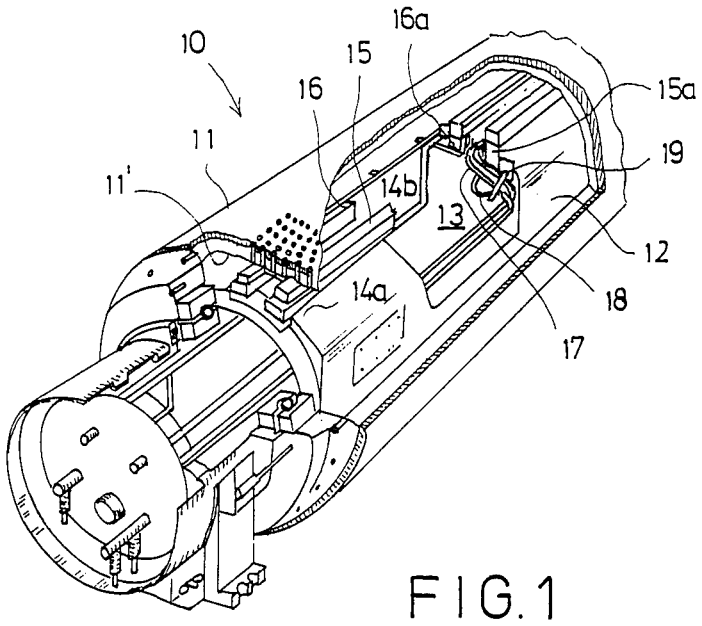
FIG. 1 is an axonometric and partially open illustration of a prior art suction roll.

FIG. 1 is an axonometric view of a conventional suction roll 10. This suction roll 10 comprises a roll mantle 11, and a suction box 12 inside the roll mantle 11. The suction box 12 defines a suction space 13 in an interior thereof. This suction space 13 can be subjected to negative pressure, whereby suction is produced in the space 13 defined by the suction box 12 in the interior thereof, and liquid can be suctioned out of a paper web.

Upper longitudinal edges **14*a* and 14*b* of the suction box 12 are provided with sealing means 15 and 16, i.e. with axial seals 15 and 16. The sealing means 15 and 16 are fitted in seal sockets 15*a* and 16*a* provided for the sealing means. In view of lowering the friction between the seals 15, 16 and the inner face 11' of the roll mantle 11, liquid is sprayed through inlet pipes 17, 18, 19 into spaces of the sockets 15*a* and 16*a* defined by the seals 15 and 16, out of which spaces the liquid is further carried along the sealed faces to lubricate the contact faces between the seals and the mantle 11**.

Figure 2:
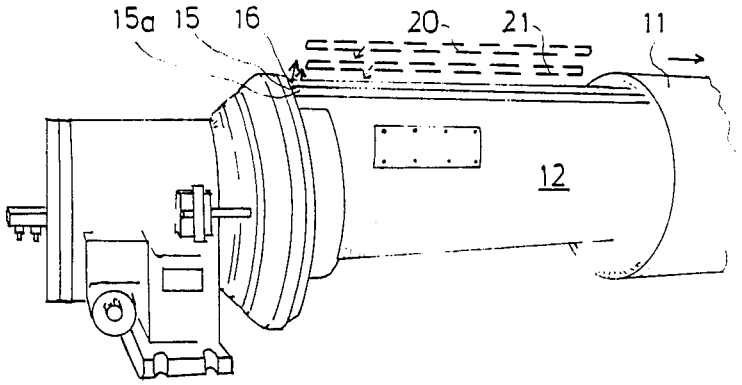
FIG. 2 illustrates removal of a mantle part of a suction roll from about a suction box, and also illustrates removal of axial seals as denoted by arrows and fitting of grinding ribs in place of the axial seals as denoted by dashed lines.

In the manner illustrated in FIG. 2, the suction box 12 of the suction roll 11 is provided with separate grinding ribs 20, 21 or equivalent, which can be positioned.

More specifically, in the manner illustrated in FIG. 2, the roll mantle 11 of the suction roll 10 is removed from around the suction box 12, and the upper edges of the suction box 12 are provided with the grinding ribs 20 and 21. The axial seals 15 and 16 are removed thereat, and the grinding ribs 20 and 21 are situated, in accordance with the present invention, into the places of the seals, i.e. into their sealing sockets 15*a* and 16*a*, as illustrated by the dashed lines.

Figure 3A:
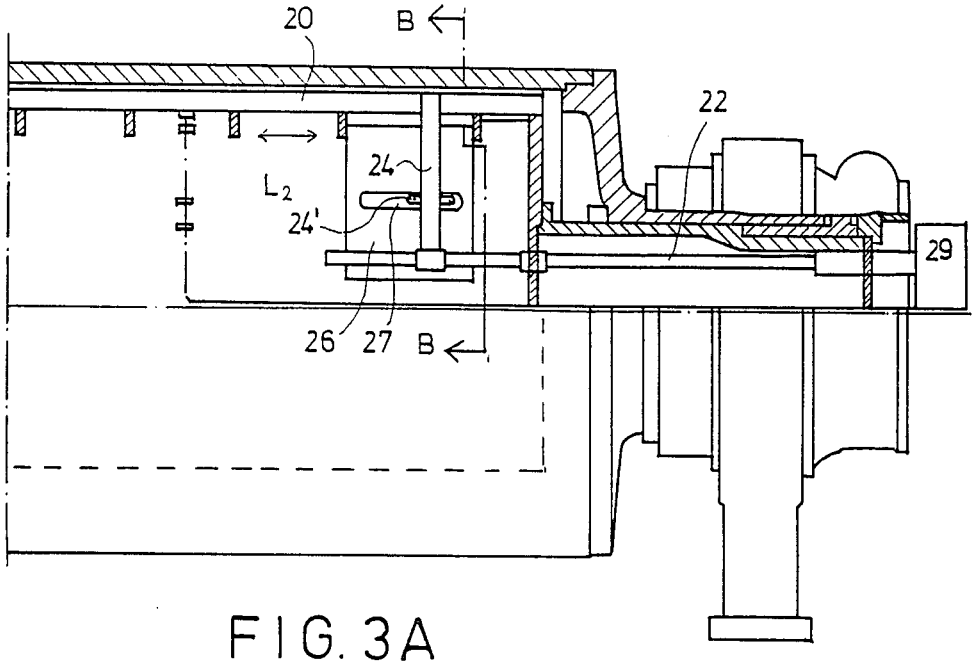
FIG. 3A is a partial sectional view of a suction roll taken along a longitudinal axis thereof and illustrating equipment in accordance with the present invention fitted in a conventional suction-roll structure.
Figure 3B:
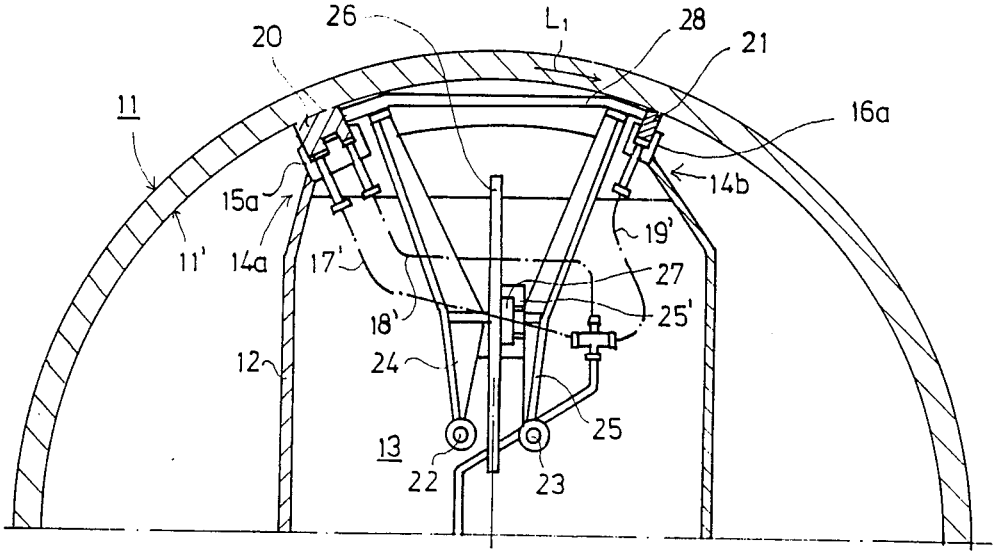
FIG. 3B is a sectional view taken along line B—B in FIG. 3A.

FIGS. 3A and 3B give more detailed illustration of the construction of a suction roll in accordance with the present invention. According to the invention, it has now been found that the conventional liquid lubrication system fitted in connection with the seals 15 and 16 can be used for passing the grinding fluid or grinding material to the point to be ground. Thus, pressure-medium supply ducts 17, 18 and 19 illustrated in FIG. 1, have been converted to grinding-fluid supply ducts 17', 18' and 19'. For example, the grinding-material supply duct 17', 18', 19' may be fitted to end in the pressure-medium supply duct 17, 18, 19 at the axial seals 15, 16 of the suction box 12.

It has also been found in accordance with the present invention that an arrangement for displacing the grinding ribs 20, 21 in a direction of a longitudinal axis of the cylinder IO, can be accomplished partially by means of existing constructions of equipment. The adjustment rod mechanism thereat for the end seals 15, 16 is utilized for displacing the grinding ribs 20, 21. Arms 24 and 25 related to the adjustment rods 22 and 23, are connected to an intermediate rod 28. Control of the arms 24 and 25 is provided through a slide opening 27 in a support plate 26, in which guiding parts 24' and 25' for the arms 24 and 25 are coupled. The intermediate rod 28 is further connected to the grinding ribs 20 and 21.

Thus, by displacing the adjusting rods 22 and 23, the grinding ribs 20 and 21 are also displaced. The grinding ribs 20 and 21 are fitted to move in the sockets 15*a* and 16*a*. The adjustment rods 22 and 23 are passed out through the end plate of the roll and outside the end plate, may be connected to a joint displacing member in a manner illustrated schematically in FIG. 3A. This displacing member is advantageously the displacing mechanism 29 for a doctor which already exists at a paper mill.

When the inner face 11' of the cylinder mantle 11 is being ground, the roll 10 is rotated on its original bearings by means of a rotating device (not illustrated in the drawing). The mantle 11 (arrow $L_1$) is rotated slowly, and at the same time the grinding ribs are displaced in an oscillating manner (arrow $L_2$) and grinding past or grinding fluid is possibly supplied through ducts 17, 18, and 19' to the contact and grinding interface between the grinding ribs 20, 21 and the inner face 11' of the mantle 11.

The grinding ribs are preferably made of polystyrene plastic into which aluminum oxide particles have been mixed to constitute grinding material. Generally, it is possible to use amide plastics into which ceramic oxides have been mixed as grinding material, for example silicon carbide or silicon nitrite oxide.

In the method of the invention, the suction roll is shifted from the paper machine into a roll warehouse of the paper mill, where the seals are substituted with the grinding ribs in accordance with the invention as noted above. The grinding is preferably carried out at the storage site for spare rolls at the paper mill, this site being provided with a rotating device for rotating the roll mantle. The devices that generate the longitudinal movement of the seals may include a doctor displacing mechanism present at the paper mill as a spare part. An advantageous length of displacing of the grinding ribs is about 50 mm, and together with the rotating of the roll mantle and the supply of the grinding fluid, the mantle face can be ground smooth and clear of the grooves formed into the same by the seals.

An embodiment of the present invention is also possible in which, instead of grinding ribs, grinding paste or grinding fluid is exclusively supplied through the lubricant supply chamber 17', 18' 19', such grinding material being further carried onto the face 11, between the axial seals and the mantle.

The preceding description of the present invention is merely exemplary, and is not intended to limit the scope thereof in any way.

I claim:

1. Method for renewal of an inner face of a roll mantle of a suction roll, comprising the step of renewing the inner face of the roll mantle by grinding while rotating the same by at least one of the steps of providing a suction body of the suction roll with at least one grinding rib whereby the grinding is started from inside the roll mantle and the at least one grinding rib is continuously maintained in contact with the inner face of the roll mantle, and providing the suction box with means for supplying grinding material into the roll whereby the grinding is started from inside the roll mantle and the grinding material is continuously maintained in contact with the inner face of the roll mantle.

2. A method for renewal of an inner face of a roll mantle of a suction roll, comprising the step of renewing the inner face of the roll mantle by grinding while rotating the same by at least one of the steps of providing a suction box of the suction roll with at least one grinding rib, and providing the suction box with means for supplying grinding material into the roll, wherein the at least one grinding rib is provided by the steps of removing axial seals of the suction box, and inserting the at least one grinding rib in place thereof.

3. The method of claim 1, wherein the supply means are provided by the steps of connecting pressure medium ducts passing to axial seals of the suction box, to a source of grinding material.

4. The method of claim 2, comprising the additional step of displacing the at least one grinding rib substantially in a direction of an axis of the roll while the roll is, at the same time, rotated on its original bearings.

5. Method for renewal of an inner face of a roll mantle of a suction roll, comprising the step of renewing the inner face of the roll mantle by grinding while rotating the same by the steps of removing axial seals of a suction box of the roll, inserting at least one grinding rib in place of the axial. seals, and connecting pressure medium ducts passing to the axial seals of the suction box, to a source of grinding material.

6. The method of claim 5, comprising the additional step of displacing the at least one grinding ribs substantially in a direction of an axis of the roll while the roll is, at the same time, rotated on its original bearings.

7. Device for renewal of an inner face of a roll mantle of a suction roll, comprising at least one grinding rib positionable within a socket of a suction box of the suction roll, for grinding the inner face of the roll mantle as it rotates, said at least one grinding rib being fitted to be movable in the socket of the suction box of the suction roll.

8. The combination of claim 7, wherein said at least one grinding rib is positionable in a pair of sockets provided in said suction box for axial seals of the suction box, with said at least one grinding rib fitted to move in both said sockets.

9. The combination of claim 8, additionally comprising a plurality of grinding ribs.

10. The combination of claim 7, wherein said at least one grinding rib contains amide plastic into which ceramic oxides have been mixed as grinding material.

11. The combination of claim 7, wherein said at least one grinding rib is made of polystyrene plastic into which aluminum oxide particles have been mixed as grinding material.

12. The combination of claim 7, additionally comprising a grinding material supply duct passing to the suction box in the suction roll.

13. The combination of claim 12, wherein said grinding material supply duct is fitted to end in a pressure medium supply duct at axial seals of the suction box.

14. The combination of claim 7, additionally comprising means for longitudinally reciprocating said at least one grinding rib in the suction box.

15. The combination of claim 14, wherein said reciprocating means comprise a lever arrangement coupled to said at least one rib and passing through an end plate of the suction roll where it is coupled to a displacing mechanism.

16. The combination of claim 7, additionally comprising means for rotating the roll, whereby the inner mantle face is scraped by said at least one rib.

17. Device for renewal of an inner face of a roll mantle of a suction roll, comprising at least one grinding rib positionable within a suction box of the suction roll, for grinding the inner face of the roll mantle as it rotates, means for longitudinally reciprocating said at least one grinding rib in the suction box, wherein said reciprocating means comprise a lever arrangement coupled to said at least one rib and passing through an end plate of the suction roll where it is coupled to a displacing mechanism, additionally comprising a plurality of grinding ribs, and wherein said reciprocating means comprise a pair of arms, each provided with a respective guide part, an intermediate rod coupled to said grinding ribs and to said arms, a support plate comprising a slide opening in which said respective guide parts are each coupled for sliding movement, and a pair of adjusting rods, each coupled to a respective arm and to the displacing mechanism.

18. Device for renewal of an inner face of a roll mantle of a suction roll in a paper machine, comprising as grinding rib (20 or 21) which, when fitted in place, is located in a socket (15*a* or 16*a*) of an axial seal (15 or 16) situated on a longitudinal edge (14*a* or 14*b*) of a suction box (12) of the suction roll (10) in the paper machine, in place of the axial seal (15 or 16).

19. The combination of claim 18, wherein said grinding rib (20 or 21) contains amide plastic into which ceramic oxides have been mixed as grinding material

20. The combination of claim 18, wherein said grinding rib (20 or 21) contains polystyrene plastic into which aluminum oxide particles have been mixed as grinding material.

* * * * *